US007259671B2

(12) United States Patent
Ganley et al.

(10) Patent No.: US 7,259,671 B2
(45) Date of Patent: Aug. 21, 2007

(54) PROXIMITY AWARE PERSONAL ALERT SYSTEM

(76) Inventors: Christine Ganley, 313 N. Lincolnway, North Aurora, IL (US) 60542; Don Ganley, 313 N. Lincolnway, North Aurora, IL (US) 60542; Maura Junius, 7423 W. Isham Ave., Chicago, IL (US) 60631-1917; Anna Maria Kirchner, 6301 Sheridan Rd., Chicago, IL (US) 60660-1721

( * ) Notice: Subject to any disclaimer, the term of this patent is extended or adjusted under 35 U.S.C. 154(b) by 0 days.

(21) Appl. No.: 10/872,875

(22) Filed: Jun. 21, 2004

(65) Prior Publication Data

US 2005/0280546 A1 Dec. 22, 2005

(51) Int. Cl.
*G08B 1/08* (2006.01)

(52) U.S. Cl. ..... 340/539.23; 340/573.1; 340/568.1; 340/989; 340/539.11; 340/686.6

(58) Field of Classification Search ..... 340/539.23, 340/573.1, 531, 571, 539.1, 539.15, 989, 340/568.1, 517, 572.1, 539.21, 692, 686.6, 340/539.13, 539.11, 10.1, 541
See application file for complete search history.

(56) References Cited

U.S. PATENT DOCUMENTS

| | | | | |
|---|---|---|---|---|
| 4,593,273 | A | 6/1986 | Narcisse | 340/539 |
| 4,675,656 | A | 6/1987 | Narcisse | 340/539 |
| 4,899,135 | A | 2/1990 | Ghahariiran | 340/573 |
| 5,119,072 | A | 6/1992 | Hemingway | 340/573 |
| 5,337,041 | A | 8/1994 | Friedman | 340/573 |
| 5,557,259 | A | 9/1996 | Musa | 340/573 |
| 5,621,388 | A * | 4/1997 | Sherburne et al. | 340/573.4 |
| 5,646,593 | A | 7/1997 | Hughes et al. | 340/573 |
| 5,661,460 | A * | 8/1997 | Sallen et al. | 340/573.4 |
| 5,708,421 | A * | 1/1998 | Boyd | 340/573.1 |
| 5,900,817 | A | 5/1999 | Olmassakian | 340/573.1 |
| 5,939,988 | A | 8/1999 | Neyhart | 340/573.4 |
| 6,075,443 | A | 6/2000 | Schepps et al. | 340/573.4 |
| 6,078,260 | A * | 6/2000 | Desch | 340/573.1 |
| 6,091,329 | A * | 7/2000 | Newman | 340/539.15 |
| 6,127,931 | A | 10/2000 | Mohr | 340/573.4 |
| 6,163,261 | A | 12/2000 | Westrick | 340/573.3 |
| 6,265,974 | B1 * | 7/2001 | D'Angelo et al. | 340/568.1 |
| 6,304,180 | B1 | 10/2001 | Platner et al. | 340/567 |
| 6,515,588 | B1 | 2/2003 | Sarabia | 340/568.1 |
| 6,542,080 | B2 | 4/2003 | Page | 340/571 |

(Continued)

OTHER PUBLICATIONS

Business Week Magazine, "No Wires, No Rules" By Heather Green, Apr. 26, 2004, pp. 95-102.

(Continued)

*Primary Examiner*—Daniel Wu
*Assistant Examiner*—Daniel Previl

(57) ABSTRACT

Disclosed is a proximity aware personal alert system including a first mobile transceiver unit and a second mobile transceiver unit in communication with the first mobile transceiver unit via an RF link where the second mobile transceiver provides an alarm indication when the first mobile transceiver has moved a predetermined distance from the second mobile transceiver unit. When the RF link is configured as a Bluetooth link, the first and second mobile transceiver units form a monitoring piconet where the second mobile transceiver unit provides the alarm indication when the first mobile transceiver unit moves beyond a distance of approximately ten meters from the second mobile transceiver unit. The first transceiver unit is worn by a monitored person such as a child and the second transceiver unit is worn by a monitoring person such as a parent of the child.

7 Claims, 5 Drawing Sheets

U.S. PATENT DOCUMENTS

| | | | | |
|---|---|---|---|---|
| 6,570,504 | B2 | 5/2003 | Rabanne et al. | 340/573.4 |
| 6,571,103 | B1 * | 5/2003 | Novakov | 455/464 |
| 6,593,851 | B1 * | 7/2003 | Bornstein | 340/539.15 |
| 6,671,351 | B2 | 12/2003 | Menard et al. | 379/45 |
| 6,704,770 | B1 | 3/2004 | Ramakesavan | 709/205 |
| 6,720,881 | B1 | 4/2004 | Halliday | 340/573.4 |
| 6,959,207 | B2 * | 10/2005 | Keinonen et al. | 455/567 |
| 2002/0080036 | A1 | 6/2002 | Rabanne et al. | 340/573.1 |
| 2002/0126012 | A1 | 9/2002 | Page | 340/571 |
| 2004/0046658 | A1 | 3/2004 | Turner et al. | 340/539.11 |

OTHER PUBLICATIONS www.oen.agh.edu.pl/online/notatki2002/1/index.php?action=en_pakiety, Bluetooth Packet Formats English Versions, Two Pages.

www.qualitylogic.com/newsletter/q4_02/tq_bluetooth.html, TeleQ Quality in the Telephony Industry, pp. 1-5; www.btdesigner.com/ftoj.htm, BT Designer: Glossary: F-J, pp. 1-4; Bluetooth Network Creation, Paging and Piconet Connection, 10 Pages; Paging Through Connection Inside, 4 Pages; Paging Through Connection Illustrated, 26 Pages.

Bluetooth Specification Version 1.1, Jun. 5, 2003, pp. 17-125 & 508-510; Lexsee 127 ILL. APP. 3E 248, 2 pages.

Part F:4, Interoperability Requirements for Bluetooth as a WAP Bearer, Jun. 5, 2003, pp. 512-526; H:1, Host Controller Interface Functional Specification, pp. 536-549.

Core System Package [Controller volume] Part F, Message Sequence Charts, Between Host and Host Controller/Link Manager, Nov. 5, 2003, pp. 594-649.

* cited by examiner

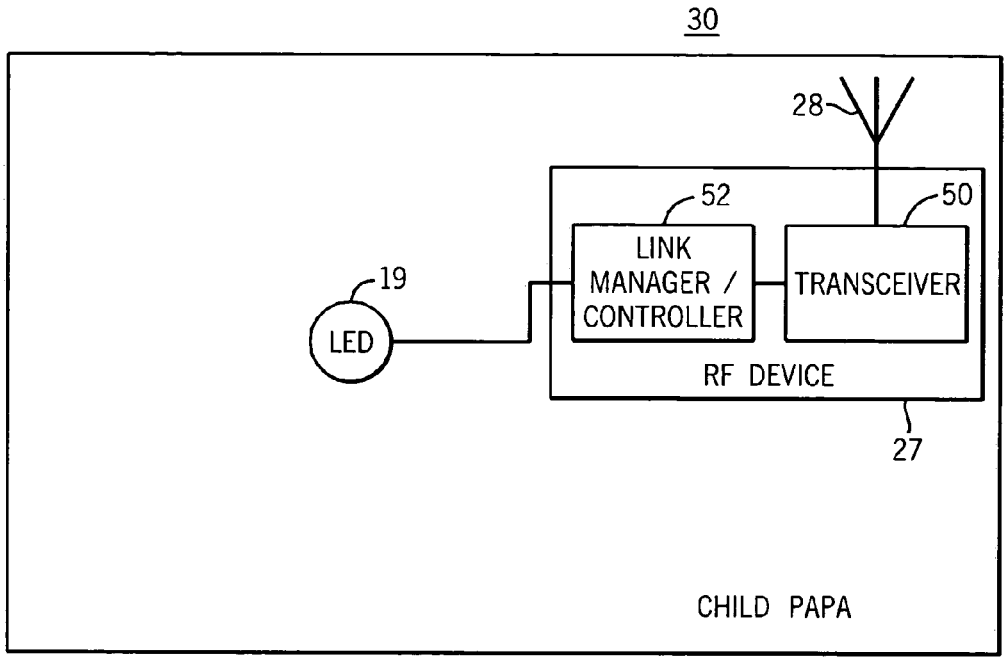
FIG. 5
FIG. 6
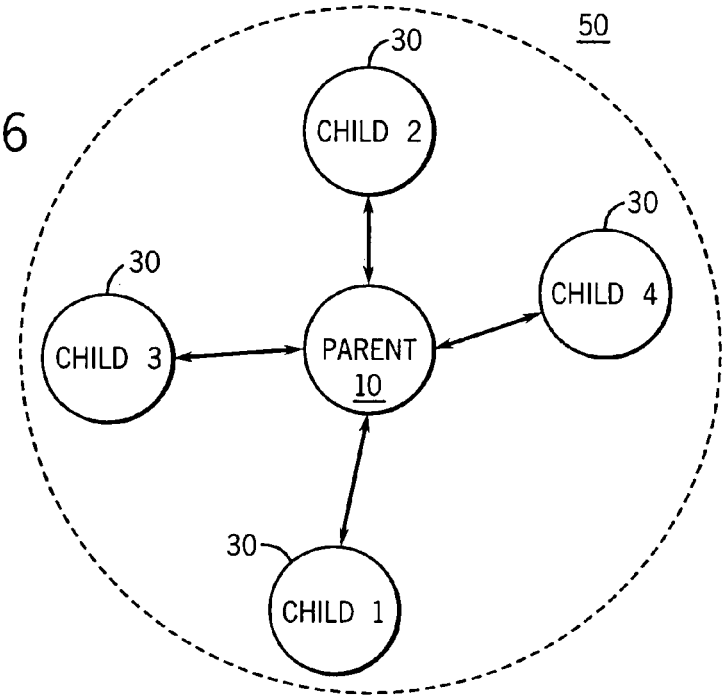

PROXIMITY AWARE PERSONAL ALERT SYSTEM

BACKGROUND

This disclosure relates to a device that prevents separation and more particularly to a portable wireless monitoring device that causes an indication when a pre-determined distance has been exceeded between two or more persons or objects.

Devices to prevent physical separation between persons and/or objects are known in the art. Although their applications vary, for example, preventing physical separation of an elderly person from their caregiver, preventing physical separation of an object from its owner, etc., devices that prevent physical separation of a child from his/her parent or caregiver have been in use for many years. For example, in the 1980's child tethering devices were not an uncommon sight at the local shopping mall. While effective for short distances, the child tethering devices were cumbersome, easily tangled and overall, visually unsettling.

Today, various electronic devices in one of many configurations have replaced the traditional child tethering devices of the past with electronic monitoring devices and monitoring device networks. For example, monitoring device networks that utilize a fixed base apparatus to prevent separation are known in the art. U.S. Pat. Nos. 4,593,273 and 4,675,656, to Narcisse entitled "Out-of-Range Personnel Monitor and Alarm," disclose an out-of-range monitor and alarm system that utilizes a fixed base unit and at least one mobile unit. Similarly, U.S. Pat. No. 6,720,881 to Halliday, entitled "Perimeter Security Systems", discloses a perimeter securing system for providing a security alarm for persons leaving or entering a predetermined area. The security system includes a main sensor wearable by a user, a perimeter defining assembly for providing an indication of a predefined area, and a remote unit for receiving a signal from the main sensor indicating that the boundary of the predefined area has been broken. Fixed base monitoring devices to prevent separation, however, do not lend themselves to mobile applications involving monitoring children on the move.

Mobile monitoring device networks that utilize mobile devices to prevent separation are known in the art. For example, U.S. Pat. No. 5,119,072 to Hemingway, entitled "Apparatus for Monitoring Child Activity", discloses an apparatus that includes a mobile child transmitter with a voice encoder, a microphone, an oscillator and an antenna, and a mobile parent receiver. The oscillator frequency modulates a radio frequency (RF) carrier signal which is then transmitted from the antenna. The parent receiver unit includes circuitry for separating the audio and carrier components of the signal received from the child transmitter, and for comparing field strength of the carrier component to a range threshold. The audio component is fed into a speaker of the parent receiver for child activity monitoring purposes. When the amplitude of the carrier component drops below a threshold, an alarm is sounded on the parent receiver indicating that the child unit is out of the desired range.

U.S. Pat. No. 5,646,593 to Hughes et al, entitled "Child Proximity Detector", discloses a child proximity detection network that includes two transceivers (transmitter/receiver) rather than a child transmitter and a parent receiver of the Hemingway patent. The 1$^{st}$ transceiver unit (parent transceiver unit) includes a parent identification number and the 2$^{nd}$ transceiver (child transceiver unit) unit includes a child identification number, assigned only upon physical connection with the 1$^{st}$ transceiver. During operation, the parent transceiver unit produces and transmits a polling message (including parent ID) to the child transceiver unit to determine if the child transceiver unit is further than a predetermined distance. Upon receipt, the child transceiver unit which "investigates" the polling message contact for matching with predetermined criteria and returns response if matched, and detects whether parent transceiver unit is more than a predetermined distance. Alarms sound if either detects other beyond the predetermined distance.

U.S. Pat. No. 5,661,460 to Sallen et al., entitled "Distance Determination and Alarm System", discloses a monitoring device network that includes at least two transceivers such as a parent unit and a child unit for generating one alarm when the child unit is more than a predetermined distance away from the parent unit. Unlike similar designs where the distance is based on signal strength, the distance of the parent and child unit of the Sallen et al. patent is determined by a phase relationship of a reference signal from the time it is transmitted on an RF signal by the parent unit, received and retransmitted by the child unit, and then received again by the parent unit.

In some cases, a direction-finding feature is added to the mobile monitoring device network. For example, U.S. Pat. No. 6,127,931 to Mohr, entitled "Device for Monitoring the Movement of a Person", discloses a homing unit (child unit) for generating and omitting a homing signal at predetermined intervals, and a base unit (parent unit) having a receiver for receiving the homing signal and a processor for processing homing signal strength and time of receipt between homing signals to determine whether the homing unit is within a predetermined distance. In addition to an alarm, the base unit includes a display for displaying the distance and direction between the base and homing unit. Similarly, U.S. patent application Publication, 2002/0046658 to Turner et al. entitled "Dual Watch Sensors to Monitor Children" and having a publication date of Mar. 11, 2004, includes a display on the caregiver or parent unit that displays which child transceiver is out of range as well as other visual indications of distances of child transceivers.

In other cases, one or more elements of the child unit are controlled by the parent unit. For example, U.S. Pat. No. 6,078,260 to Desch entitled "Method and Apparatus for Keeping Track of Children" discloses a system for monitoring the proximity and location of a child (having a child transceiver unit) by a parent (having a parent transceiver unit). In addition to a directional indicator, the parent transceiver unit includes a power switch which controls powering of both child and parent transceiver units and which when activated causes the parent transceiver unit to transmit a signal to activate the child transceiver unit. Similarly, in U.S. Pat. No. 5,939,988 to Neyhart, entitled "Child Proximity Monitor and Alarm", an alarm included in the child transceiver unit is only deactivated via a deactivation signal from the parent unit. Likewise, U.S. Pat. No. 6,542,080 to Page, entitled "Monitoring Device to Prevent Separation", discloses a wearable transmitter portion for the monitored child and a wearable receiver portion for the monitoring parent. The receiver portion includes a predetermined separation parameter, a means for determining distance between, an alarm and a reset button for turning off the receiver portion alarm and for resetting the alarm. The transmitter portion also has an alarm, however it can only be turned off by the receiver portion.

More advanced mobile monitoring devices that include GPS systems are also known in the art. U.S. Pat. No. 5,900,817 entitled "Child Monitoring System" to Olmassakian, and U.S. Pat. No. 6,570,504 and U.S. Published patent application US 2002/0080036 to Rabanne et al, entitled "System for Tracking Possessions" disclose mobile monitoring devices that indicate not only that a child or possession has moved beyond a pre-determined maximum distance limit but also indicate a distance and direction via an GPS assembly included in the monitoring devices.

SUMMARY

The proximity aware personal alert (PAPA) system disclosed herein improves on the prior art in a number of ways. Among other things, it is simple to use, inexpensive, mobile, adaptable and secure. With a focus on providing an indication to the monitoring person (having a parent PAPA unit) when a monitored person (having a child PAPA unit) has strayed too far, there is no need for additional circuitry to determine exact distances or direction. In addition, there is no need for additional circuitry to engage location finding services such as services relying on the use of the global positioning satellite system (GPS). As a result, the proximity aware personal alert system disclosed herein is inexpensive to build.

Further, by utilizing one of the wireless technologies described herein, signals transmitted and received on an established and synced RF link between the parent PAPA unit and the child PAPA units are secure against tampering.

The design of the child PAPA unit prevents its easy removal from the monitored person or object. As a result, neither the a monitored child nor a would-be abductor can quickly remove the child PAPA unit from the monitored child. Similarly, the design of the child PAPA unit prevents a powered-off condition from occurring during use, prevents interruption of an established RF link to the parent PAPA unit 10 during use, and prevents RF link establishment with devices other than the parent PAPA device 10 during use. As a result, neither the monitored child nor a would-be abductor can turn off the child PAPA unit or interrupt an established RF link to the parent PAPA unit 10. Therefore any termination of expected transmission from the child PAPA unit indicates that the monitored child or object has moved out of range of, or a predetermined distance from the monitoring person.

The PAPA system includes a first mobile transceiver unit and a second mobile transceiver unit in communication with the first mobile transceiver unit via an RF link where the second mobile transceiver provides an alarm indication when the first mobile transceiver has moved a predetermined distance from the second mobile transceiver unit. When the RF link is configured as a Bluetooth link, the first and second mobile transceiver units form a monitoring piconet where the second mobile transceiver unit provides the alarm indication when the first mobile transceiver unit moves beyond a distance of approximately ten meters from the second mobile transceiver unit. The distance may be adjusted via the addition of a signal amplification device (e.g., a power amplifier) and a user accessible RF range adjustment mechanism to the second mobile transceiver unit. The first transceiver unit is worn by a monitored person such as a child and the second transceiver unit is worn by a monitoring person such as a parent of the child.

Other objects, advantages and novel features of the present disclosure will become apparent from the following detailed description when considered in conjunction with the accompanying drawings.

BRIEF DESCRIPTION OF THE DRAWINGS

FIG. 5 is a functional block diagram of a number of components that may be included in the child PAPA unit of FIG. 2;

FIG. 6 is an exemplary monitoring piconet established by the parent PAPA unit of FIG. 1 and further including three child PAPA units of FIG. 2 in accordance with an embodiment of the invention;

DETAILED DESCRIPTION

Figure 1:
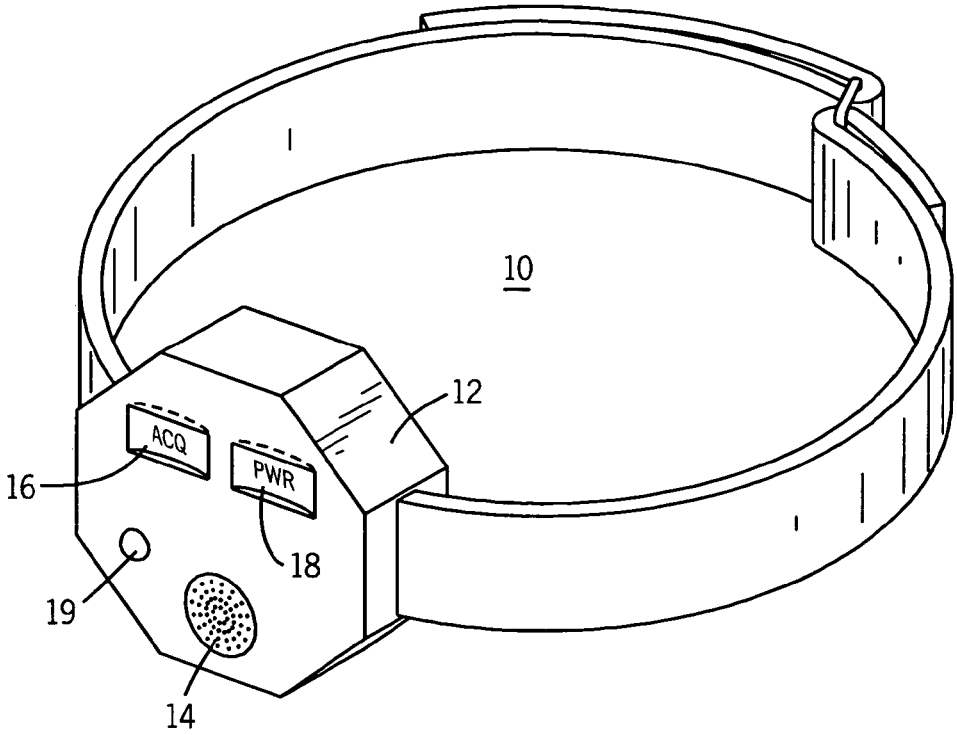
FIG. 1 is a perspective view of an exemplary parent proximity aware personal alert (PAPA) unit in accordance with an embodiment of the invention.

While the present disclosure may be susceptible to embodiment in different forms, there is shown in the drawings, and will be described herein in detail, one or more embodiments with the understanding that the present description is to be considered an exemplification of the principles of the disclosure and is not intended to be exhaustive or to limit the disclosure to the details of construction and the arrangements of components set forth in the following description or illustrated in the drawings.

FIG. 1 is a perspective view of an exemplary parent proximity aware personal alert (PAPA) unit 10 in accordance with an embodiment of the invention. The parent PAPA unit 10 includes a housing 12 upon which is mounted a speaker 14, a light emitting diode (LED), an acquire (ACQ) button 16 and a power (PWR) button 18, all of which are coupled to a controller 20 (discussed below in connection with FIG. 4) concealed within the housing 12. The housing 12 is preferably constructed of a light weight and water resistant material such as plastic. Also included within the housing 12 is a radio frequency (RF) device 26 coupled to the controller 20. The radio frequency device 26 is adapted to provide an RF link to other like devices over intervening air space.

Figure 2:
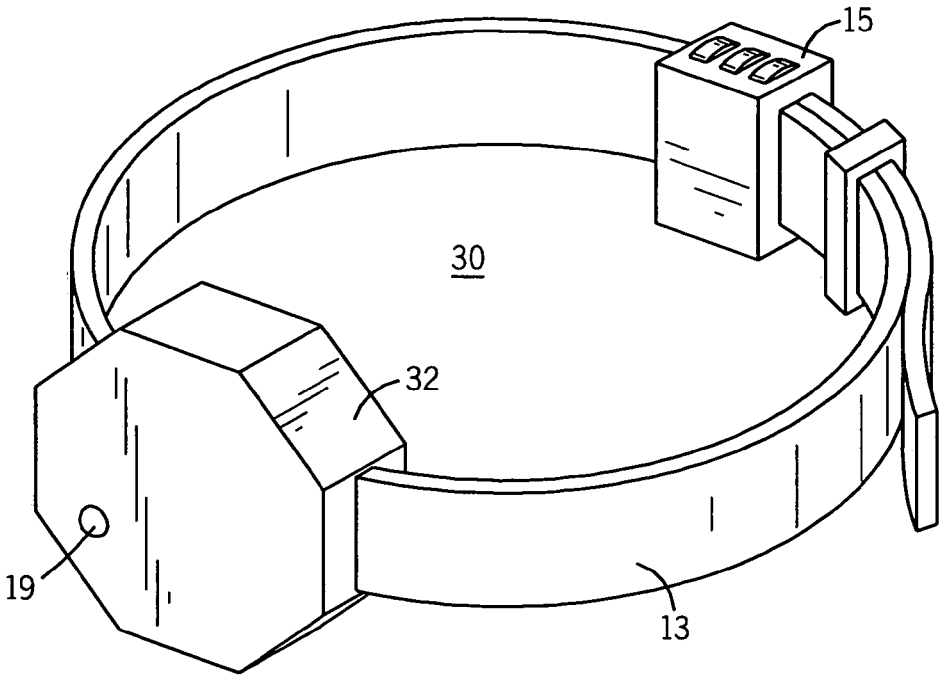
FIG. 2 is a perspective view of an exemplary child PAPA unit in accordance with an embodiment of the invention.

FIG. 2 is a perspective view of an exemplary child PAPA unit 30 in accordance with an embodiment of the invention. Like the parent PAPA unit 10 of FIG. 1, the child PAPA unit 30 includes a housing 32 enclosing an RF device 27 configured and operable as described in connection with the RF device 26 of FIG. 1. An LED 19, mounted to the housing 32, is coupled to the RF device 27. Although lightweight, the housing 32 is preferably constructed of a crush resistant material to prevent its breakage by a child or by a would-be abductor. For example, the housing 32 may be constructed of a light weigh metal alloy or ceramic/plastic combination material. A cartoon character or one of any number of other images appealing to the child or other holder of the child PAPA apparatus 30, may also be included on the housing 32.

Figure 3:
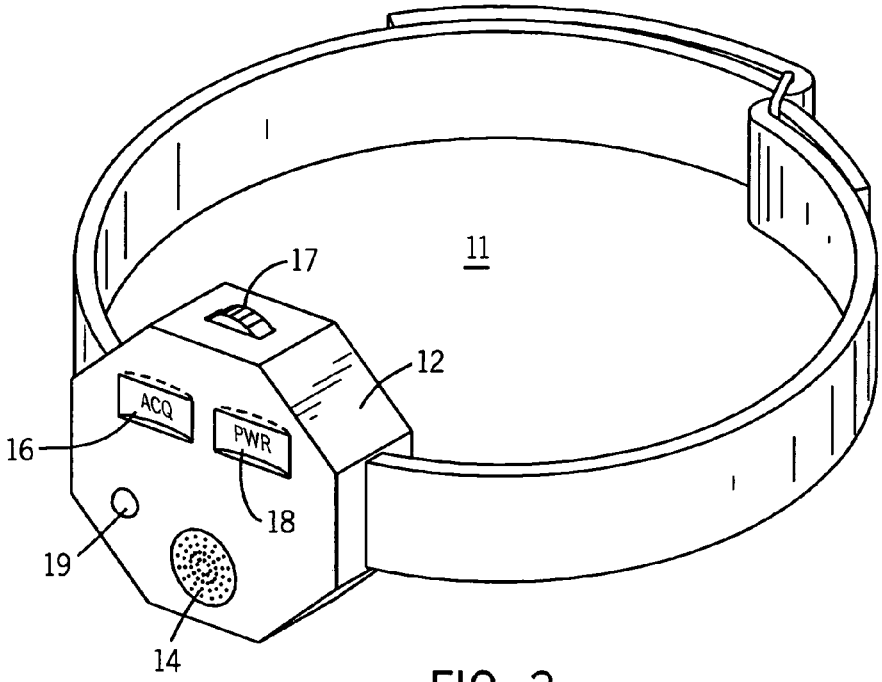
FIG. 3 is a perspective view of another exemplary child PAPA unit in accordance with an embodiment of the invention.

FIG. 3 is a perspective view of another exemplary parent PAPA unit 11 in accordance with an embodiment of the invention. In addition to the components discussed in connection with the parent PAPA unit of FIG. 1, the parent PAPA unit of FIG. 3 includes a user accessible RF range adjustment mechanism 17 such as a rotatable wheel to enable adjustment of the transmission and reception range of the parent PAPA unit 11. One or more of any suitable signal amplification devices (not separately illustrated) coupled the RF device 26 and the RF range adjustment mechanism 17 may provide additional adjustable transmission and reception range above that provided by the RF device 26 alone. As a result, manual adjustments made via the RF range adjustment mechanism 17 may be made to vary the transmission and reception capability of the parent PAPA device 11 to one of any number of distances between a nominal distance provided by the RF device 26 alone and a maximum distance provided by the RF device 26 coupled to the suitable signal amplification device.

For example, a suitable power amplifier, coupled to the RF range adjustment mechanism 17, may be utilized to provide dynamic power control to the RF device 26 to vary the transmission and reception distances of the parent PAPA device 11. Similarly, a suitable antenna and/or an RF device having adjustable sensitivity may be used. It should be understood that the child PAPA unit 30 may also include a suitable signal amplification device in order to extend its transmission and reception distances beyond that provided by the RF device 27 contemplated in FIG. 2. The child PAPA device 30 however, preferably does not include the RF range adjustment mechanism 17.

Unlike the parent PAPA units 10, 11, the child PAPA unit 30 does not include an acquire button or a power button for reasons that will be detailed below. Additionally, the child PAPA unit 30 does not include a separate controller. As a result, functionality and control of the child PAPA unit 30 is performed by its included RF device 27. A speaker, configured and operable as described in connection with the speaker 14 of FIG. 1 may however, be included in the child PAPA unit 30, depending on the desired design.

Although not separately illustrated, each of the parent PAPA units 10, 11 and the child PAPA unit 30 also includes a power supply, preferably a rechargeable battery, sized to be contained with the their respective housings. If a rechargeable battery is utilized, each of the parent PAPA unit 10 and the child PAPA unit 30 also includes a suitably configured charger port mounted in their respective housings and coupleable to a suitably configured charger cable.

The LED 19 of each of the parent PAPA units 10, 11 and the child PAPA unit 30 may be configured to visually notify a holder of a charged battery condition. For example, if a bi-color LED 19 is selected for use in the parent and child PAPA units 10, 11, 30, the LED 19 may emit a red color to indicate that a charge is needed, and may emit a green color to indicate a fully charged condition. Thus, much like a mobile phone or personal digital assistant (PDA) device, the parent and child PAPA units 10, 11, 30 may be conveniently charged for subsequent use.

In addition, although not illustrated in detail, it is contemplated that each of the parent PAPA units 10, 11 and the child PAPA unit 30 may also include a means for attaching to a person or object, for example, a loop or pouch configured and sized for use with a belt, a wrist strap, a pendant strap, etc. In a preferred embodiment, the child PAPA unit 30 is attached to the body in such as way as to discourage easy removal, for example, attached via a sturdy, cut-resistant wrist strap 13 that may include a locking mechanism 15 for latching. The locking mechanism 15 may be one of any number of suitable locking mechanisms, for example a combination lock. The parent PAPA unit 10, 11 may be latched via a simple buckle or VELCRO™.

The parent PAPA unit 10, 11 and the child PAPA unit 30 are adapted to communicate for purposes of alerting a holder of the parent PAPA unit 10, 11 (e.g., parent, caregiver, guardian, etc.) when the holder of the child PAPA unit 30 (e.g., child, elderly person, pet, etc.) has moved beyond a predetermined distance from the parent PAPA unit 10. Thus, the RF devices of the parent and child PAPA units 10, 11, 30 may be configured using one of variety of suitable radio links, depending on the desired range and/or security level.

One particularly advantageous radio link is the Bluetooth radio link (see, www.bluetooth.org/spec/) which is a short-range, cable replacement, radio technology. The Bluetooth radio link utilizes the 2.4 GHz Instrumentation, Science, Medical (ISM) unlicensed band. Un-enhanced, Bluetooth enabled RF devices of the parent and child PAPA units 10, 30 may be set to a nominal range of 10 meters. Enhanced with a power amplifier and an adjustment means however, the Bluetooth enabled RF devices of the parent and child PAPA units 11, 30 may be adjusted to communicate with other "acquired" Bluetooth enabled RF devices at distances of up to 100 meters (see, FIG. 3). Although described herein as utilizing a Bluetooth radio link, it is contemplated that other short range or adjustable radio links (e.g., IEEE 802.11b, IEEE 802.11b, IEEE 802.11g, etc.) may be utilized in the RF devices 26, 27 of the parent and child PAPA units.

Figure 4:
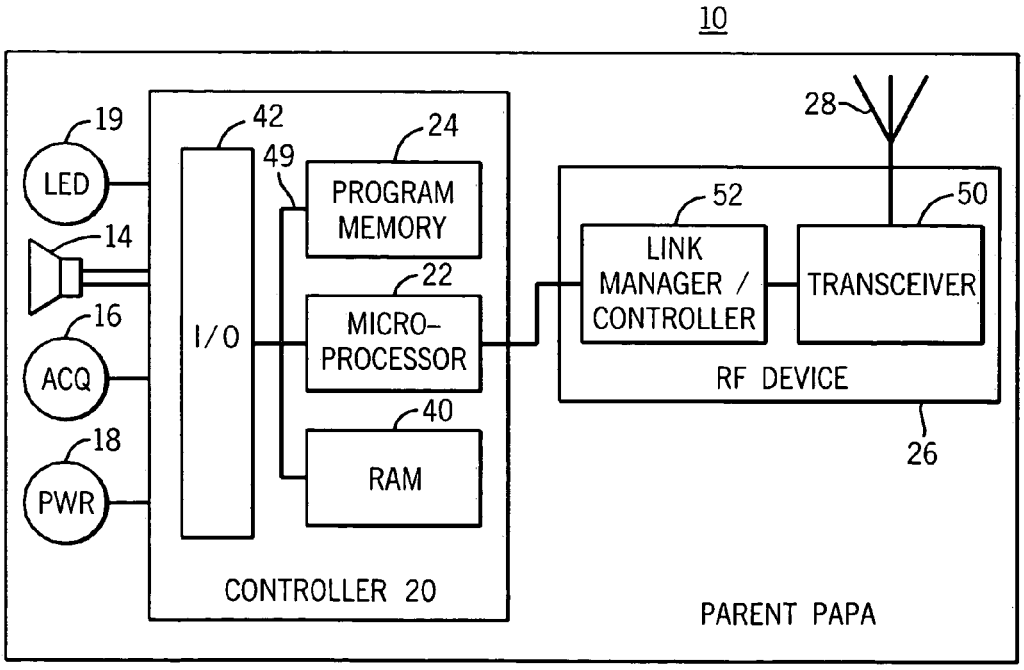
FIG. 4 is a functional block diagram of a number of components that may be included in the parent PAPA unit of FIG. 1.

FIG. 4 is a functional block diagram of a number of components of the parent PAPA unit 10. Referring to FIG. 4, the parent PAPA unit 10, 11 includes the controller 20 coupled to the RF device 26. The controller 20 includes one or more of a program memory 24 (including a read only memory (ROM)), a microcontroller-based platform or microprocessor (MP) 22, a random-access memory (RAM) 40 and an input/output (I/O) circuit 42, all of which may be interconnected via an address/data bus 44. Among other things, the microprocessor 22 is capable of causing audible sounds to be generated upon occurrence of predetermined conditions (e.g., an alarm condition). The RAM 40 is capable of storing event data or other data used or generated during operation of the parent PAPA unit 10, 11. The program memory 24 is capable of storing program code that controls the operation of the parent PAPA unit 10, 11.

It should be appreciated that although one microprocessor 22, one RAM 40 and one program memory 24 are shown, other controller configurations are possible. For example, the controller 20 may include multiple RAMs 40 and multiple program memories 24. The RAM 40 and program memory 24 may be implemented as semiconductor memories, magnetically readable memories, and/or optically readable memories, etc. Further, although the I/O circuit 42 is shown as a single block, it should be appreciated that the I/O circuit 42 may include a number of different types of I/O circuits, for example, one or more of a pulse code modulation (PCM) circuit, a universal serial bus (USB) circuit, a universal asynchronous receiver/transmitter (UART) circuit, depending on the desired interface configuration. In addition, FIG. 4 illustrates that multiple peripheral devices, depicted as the speaker 14, the ACQ button 16, the PWR button 18 and the LED 19, may be operatively coupled to the I/O circuit 42.

The RF device 26 includes a Bluetooth transceiver 50 coupled to a Bluetooth link manager/controller 52 and an antenna 28. The Bluetooth transceiver 50 includes a transceiver for transmitting a communication to, and receiving a communication from other selected Bluetooth devices using well known methods. The Bluetooth link manager/controller 52 therefore includes a memory element (e.g., RAM, ROM), a controller element, a management element and an I/O (not separately illustrated), to provide baseband processing, management and control of the Bluetooth RF link. The antenna 28 facilitates communications over intervening air space to/from selected child PAPA units 30. Although concealed within the housing interior for reasons of durability and aesthetics, it is contemplated that the antenna 28 may extend from an exterior portion of the housing 12.

It should be appreciated that although the controller 20 is a preferable implementation, the parent PAPA unit 10, 11 may also include implementation via one or more application specific integrated circuits (ASICs), field programmable gate arrays (FPGA), adaptable computing integrated circuits, or one or more hardwired devices. Is should also be appreciated that although the controller 20 is shown coupled to the Bluetooth link manager/controller 52, it is contemplated that the functionality of the controller 20 may be subsumed by the link manager/controller 52, rendering inclusion of the separate controller 20 unnecessary.

FIG. 5 is a functional block diagram of a number of components of the child PAPA unit 30. As mentioned above, unlike the parent PAPA unit 10, 11, the child PAPA unit 30 does not include an ACQ button or a PWR button. This ensures that the child being monitored can not power-off his/her device, cannot interrupt an established RF link to the parent PAPA unit 10, 11 and cannot establish RF links with devices other than the parent PAPA device 10, 11. It does however, include the RF device 27 coupled to the LED 19. As a result, aspects of child PAPA unit operation may be provided by the link manager/controller 52 of the RF device 27 rather than by a separate controller.

One manner in which the parent and child PAPA units 10, 11, 30 may operate is described below in connection with one or more flowchart(s) that represents a number of portions or routines of one or more computer programs, which may be stored in one or more of the memories of either the controller 20 or the link manager/controller 52.

Utilizing Bluetooth technology, the parent PAPA unit 10, 11 can be linked to up to seven child PAPA units 30 to form a "monitoring piconet" or a personal area network, where the proximity of child PAPA unit(s) holders can be monitored. Generally, to establish such a monitoring piconet, RF characteristics of the child PAPA unit(s) 30 are aligned to respective RF characteristics of the parent PAPA unit 10, 11. Although discussed below using the parent PAPA 10 it should be understood that the same principals apply to parent PAPA unit 11.

Specifically, in order for the parent PAPA unit 10 to "acquire" child PAPA unit(s) 30 and form the monitoring piconet, using a series of paging messages the parent PAPA unit 10 aligns the frequency hopping sequence and timing of the child PAPA unit(s) 30 to its own frequency hopping sequence and timing.

For example, FIG. 6 is a Bluetooth enabled monitoring piconet 50 established by the parent PAPA unit 10 (carried by a parent or guardian) and includes three child PAPA units 30 (each carried by a child) in accordance with an embodiment of the invention. As illustrated by FIG. 6, each of the three child PAPA units 30 is in communication with the parent PAPA unit 10. However, the three child PAPA units 30 are not in communication with each other. Thus, in addition to the child PAPA unit design precluding formation of inadvertent RF links with other like RF devices in the vicinity, once established, characteristics of the RF links of monitoring piconet 50 preclude formation of inadvertent RF links between child PAPA units 30.

Once acquired and on-channel with the parent PAPA unit 10, each of the child PAPA units 30 must nominally be located within 10 meters of the parent PAPA unit 10 to remain in the monitoring piconet. As described below, an indication, preferably audible, will signal a holder of the parent PAPA unit 10 when a child PAPA unit(s) 30 has moved out of RF range of the parent PAPA unit 10. It should be understood that although the RF device 26 of the parent PAPA unit 10 and the RF device 27 the child PAPA units 30 are functionally symmetric with each other in that each can become a master or slave radio, the parent PAPA unit 10 is adapted to be the master radio and the child PAPA units 30, the slave radios.

Prior to establishing the monitoring piconet 50, each of the parent and child PAPA units 10, 30, respectively, have a unique Global ID associated with a particular hopping pattern and clock offset that provides the offset into the hopping pattern. As mentioned above, the parent PAPA unit 10 coordinates establishment of the monitoring piconet 50 and ensures that all PAPA units of the monitoring piconet 50 are aligned with the parent PAPA unit's particular hopping pattern and clock offset.

After powering-on, the parent PAPA unit 10 must first acquire the child PAPA unit(s) 30, pass its unique Global ID to the child PAPA unit(s) 30 and vice versa, and then finally ensure that each child PAPA unit 30 is synced to the hopping pattern and offset within that pattern (i.e., the timing) of the parent PAPA unit 10. Once acquired and on-channel transmissions between the parent and child PAPA units 10, 30 continue until signals transmitted by the child PAPA unit 30 are no longer detected by the parent PAPA unit 10 or until a signal transmitted by the child PAPA transmission falls below a predetermined threshold as measured by the parent PAPA unit 10, or until one of the PAPA units falls out of sync, and/or vice versa.

Figure 7:
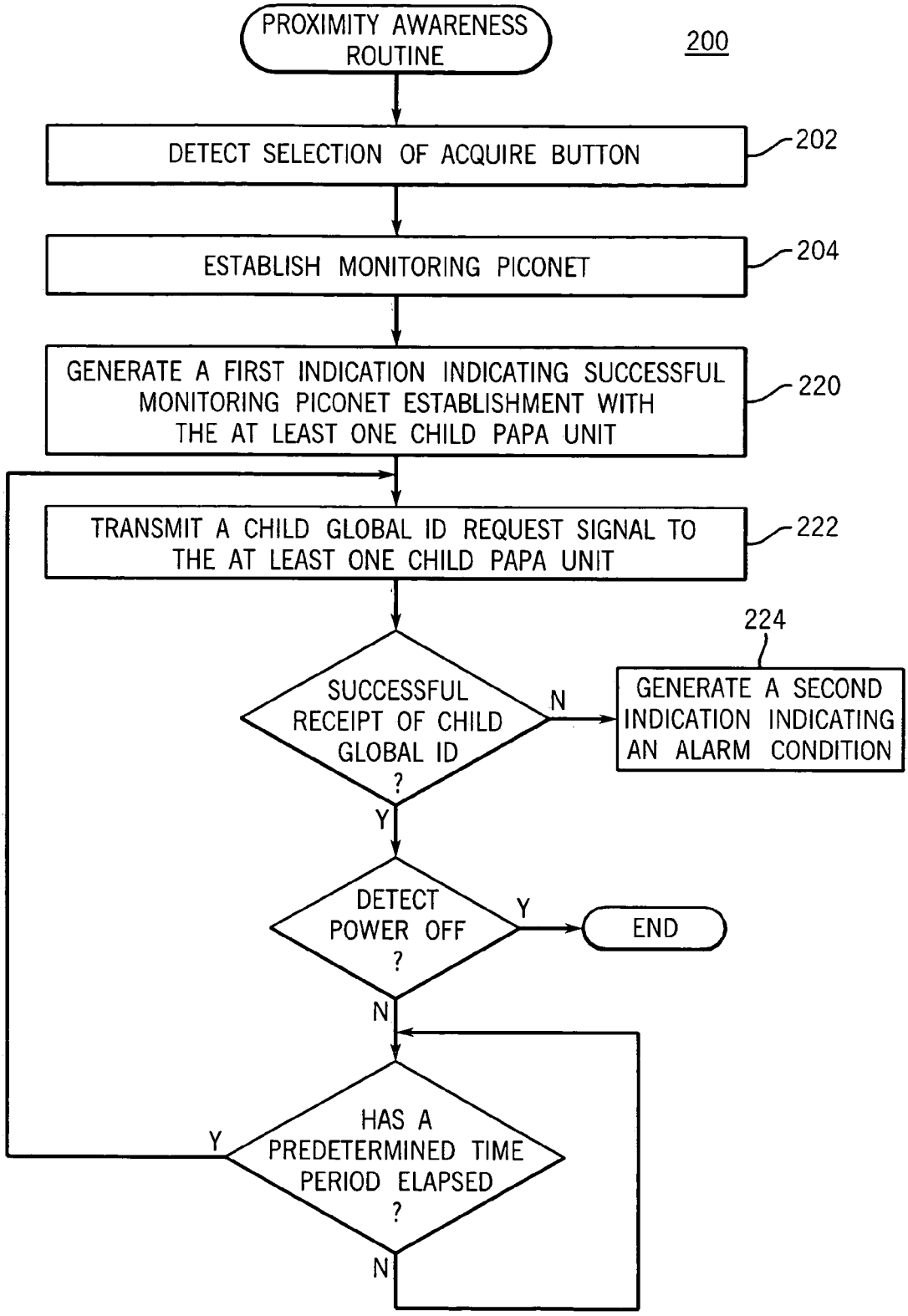
FIG. 7 is a flowchart of a proximity awareness routine that may be performed by the parent PAPA unit of FIG. 1 in accordance with an embodiment of the invention.

FIG. 7 is a flowchart of a proximity awareness routine 200 that may be performed by the parent PAPA unit 10 in accordance with an embodiment of the invention. The proximity awareness routine 200 provides one example of establishing a monitoring piconet such as the monitoring piconet 50, and then notifying a holder of the parent PAPA unit 10 when a child PAPA unit 30 moves out of RF range of the parent PAPA unit 10. Although discussed below in the context of a wearable watch-like unit for illustrative purposes, it is contemplated that the proximity awareness routine 200 may be executed in conjunction with one of any number of suitable mobile devices. In addition, although preferably performed by the controller 20, it is contemplated that the proximity awareness routine 200 may be performed by the RF device 26 or by another controller coupled to the RF device 26.

Referring to FIG. 7, prior to beginning the proximity awareness routine 200, the controller 20 detects actuation of the PWR button 18. The PWR button 18 is preferably adapted to be actuated via sliding up or down, or via depressing. If actuated via depressing, the PWR button 18 is preferably protected from inadvertent depressing by the addition of button guard (i.e., a raised housing edge around the perimeter of the PWR button 18) and/or a concave button face having perimeter edges flush with the surface of the housing 12. Conversely, the child PAPA unit 30 is always powered on when in a charged condition so that it cannot inadvertently be powered-off by its holder (e.g., a child) or purposely powered-off by an abductor or the like.

If the parent PAPA unit 10 is powered on and the child PAPA unit 30 is charged, the proximity awareness routine 200 begins upon detecting actuation of the ACQ button 16

(step 202) of the parent PAPA unit 10 (see, FIG. 3). Detection of actuation of the ACQ button 16 causes the controller 20 to initiate establishment of the monitoring piconet.

Figure 8:
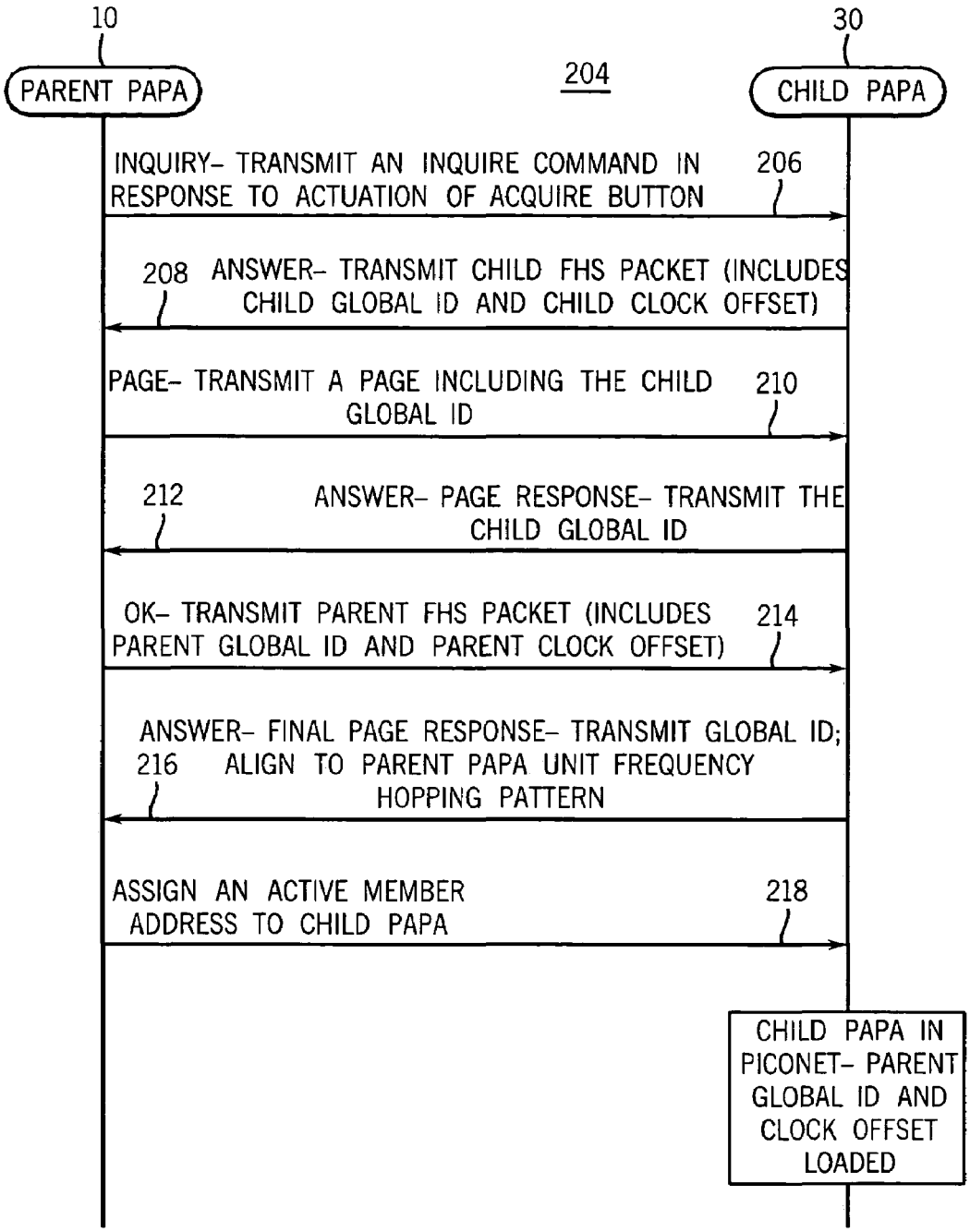
FIG. 8 is a high level ladder flow of the sequence of steps required to establish the RF link between the parent and child PAPA units of FIGS. 1 and 2.

FIG. 8 is a high level ladder flow of a method 204 for establishing a monitoring piconet that includes Bluetooth RF links between the parent and child PAPA unit(s) 10, 30. Referring to FIG. 8, upon detecting actuation of the ACQ button 16, the controller 20 causes the RF device 26 to execute an Inquiry procedure to discover the Global ID(s) of one or more child PAPA units 30 intended for the monitoring piconet (step 206). Preferably, the child PAPA unit(s) 30 is powered-up (as indicated by its LED 19) and in a "Standby" state, listening, via an Inquiry scan every 1.25 seconds over a unique sequence of 32 channels, for an "Inquiry" (i.e., page function on a special global address that has been set aside for the Inquiry procedure) from the parent PAPA unit 10. In response to receipt of the Inquiry from the PAPA unit 10, the child PAPA 30 transmits its Global ID (step 208) via a child frequency hopping selection (child FHS) packet that also includes, among other things, its clock offset.

In one embodiment, the parent PAPA unit 10 simply accepts the received Global ID of the child PAPA unit 30 per the standard Bluetooth protocol. In another embodiment, the parent PAPA unit 10 compares the received Global ID of the child PAPA unit 30 with a list (e.g., a lookup table) of acceptable Global IDs stored in memory. If the received Global ID does not appear in the list, then that particular child PAPA unit or other Bluetooth device is excluded from a subsequent Paging procedure used to establish the RF link. In yet another embodiment, the list of acceptable Global IDs is resident in the memory of the parent PAPA unit 10 and therefore, the Paging procedure may begin by broadcasting a Page command to the intended child PAPA unit(s) 30 at a predetermined clock offset.

Upon receipt of an acceptable child Global ID (via the child FHS packet) from the child PAPA unit 30 responding to the Inquiry, the parent PAPA unit 10 establishes the RF link to the child PAPA unit 30. Specifically, the parent PAPA unit 10 begins to systematically broadcast a Page command across the 32 page scanning channels of the child PAPA unit 30 based on the child Global ID, the frequency hopping pattern and clock offset received via the child FHS packet (step 210). The timing of the broadcast scan is aligned to the frequency where the parent PAPA unit 10 believes the child PAPA unit 30 would most likely be. When the child PAPA unit 30 receives the Page command addressed to its Global ID, a coarse frequency hopping synchronization between the parent and child PAPA units 10, 30 is established. The child PAPA unit 30 then acknowledges receipt of the Page command to the parent PAPA unit 10 by transmitting a Page response that again includes its child Global ID (step 212).

Upon receipt of the Page response from the child PAPA unit 30, the parent PAPA unit 10 transmits a time aligned FHS packet to the child PAPA unit 30 and "freezes" its own frequency hopping generator (step 214). Next, upon receipt of the time aligned FHS packet from the parent PAPA unit 10, the child PAPA unit 30 transmits a final Page response that once again includes its child Global ID. The child PAPA unit 30 also adopts the frequency hopping pattern of the parent PAPA unit 10 (step 216). At this point, the parent PAPA unit 10 switches to its own frequency hopping pattern and clock offset, enters a "Connection" state and assigns the child PAPA unit 30 a 3-bit Active Member Address (AMA) for the monitoring piconet (step 218). Finally, the parent PAPA unit 10 transmits a Polling packet to the child PAPA unit 30, the child PAPA unit 30 acknowledges receipt of the Polling packet, and then each PAPA unit transmits and responds to a series of control messages to further synchronize and characterize the RF link. Nominally, establishment of the RF link is completed in 1.28–2.56 seconds.

Referring again to FIG. 7, upon successful establishment of the RF link between the parent PAPA unit 10 and the child PAPA unit 30, the controller 20 causes an indication to the parent or other holder of the parent PAPA unit 10 (step 220). The indication signals to the holder of the parent PAPA unit 10 that the RF link has been established.

The indication is preferably an audible indication such as a brief chirp delivered via the speaker 14. The indication may also be visual, for example, blinking of the LED 19. In another embodiment, a visual indication may be also displayed on the child PAPA unit 30 to signal the successful establishment of the RF link. The visual indication displayed on the child PAPA unit 30 may be caused by the controller 20 or by the link manager controller 52 of the parent or child PAPA unit 10, 30, depending on the design of the PAPA system.

After establishment of the monitoring piconet as described above, the parent PAPA unit 10 begins monitoring the proximity of the child PAPA units 30 to determine whether the child PAPA unit(s) 30 is/are in RF range. Specifically, the parent PAPA unit 10 begins transmitting periodic ID Requests to each child PAPA unit 30 in the monitoring piconet. The ID requests prompt each child PAPA unit(s) 30 to respond with an identity packet that includes its child Global ID (step 222). The identity packet is preferably a standard Bluetooth packet (i.e., Bluetooth packet that includes access code, header and payload) but may be configured in one of any number of acceptable Bluetooth packet formats depending on the design of the PAPA system.

Transmission of the ID Requests by the parent PAPA unit 10 preferably occur every 2 seconds. It is contemplated however, that the rate at which the ID Requests are transmitted may be one of any number of suitable of rates for example, every second, every 3 seconds, every 3.5 seconds, etc.

If the child PAPA unit 30 is actively connected in the monitoring piconet, indicating that it is within an acceptable distance from the parent PAPA unit 10, it responds to the ID Request by transmitting its Global ID to the parent PAPA unit 10. Then, after a predetermined time period has elapsed (e.g., 3.5 seconds), the parent PAPA unit 10 transmits another ID Request to the child PAPA unit 30 requesting that the child PAPA unit 30 respond with its Global ID (step 222). This process continues until (1) the parent PAPA unit 10 is powered off or (2) the child PAPA unit 30 does not timely respond to an ID Request from the parent PAPA unit 10.

If the child PAPA unit 30 is not actively connected in the monitoring piconet, indicating that it has moved an unacceptable distance from the parent PAPA unit 10, it cannot respond to the ID Request. Similarly, even if the child PAPA unit 30 has received the ID Request but subsequently becomes disconnected from the monitoring piconet, indicating that it has moved an unacceptable distance from the parent PAPA unit 10, the parent PAPA unit 10 will not receive a timely response from the child unit 30. If the parent PAPA unit 10 does not receive a timely response due to any circumstance an alarm indication is generated notifying the holder of the parent PAPA unit 10 that the child PAPA unit 30 has moved too far away from the parent PAPA unit 10. In this way, a child's proximity to the parent can be easily monitored and the parent alerted when the child has moved an unacceptable distance from the parent.

As mentioned above, the parent and child PAPA units 10, 11, 30 are preferably configured as described in connection with FIGS. 1–5. It is contemplated however, that other mobile devices having short range RF capability, for example a Bluetooth enabled cell phone or a PDA, may be configured with parent PAPA unit functionality, child PAPA unit functionality, or both.

As also mentioned above, the parent and child PAPA units 10, 30 operate as described in connection with FIGS. 7 and 8 representing a number of portions or routines of one or more computer programs, which may be stored in one or more of the memories of either the controller 20 or the link manager/controller 52. Although such portions or routines of one or more computer programs PAPA (software) described in connection with FIGS. 7 and 8 are preferably included in the parent and/or child PAPA units 10, 30, it is contemplated that that they may be downloaded from a suitably configured server via a suitably configured browser displayed via a personal computer.

For example, PAPA software in the parent and child PAPA units 10, 30 may be upgraded via a PAPA unit docking device operatively coupled to a personal computer. The PAPA unit docking device may be coupled to the personal computer in one of many ways including via a cable link (e.g., a USB), an infrared link, a Bluetooth link, a WiFi link, a WiMax link, a Mobile-Fi link, an Ultrawideband link, to name a few. The holder of the parent and/or child PAPA units 10, 30 can then place the parent and/or child PAPA units 10, 30 in the PAPA unit docking device, access the appropriate PAPA software via their browser and download the PAPA software to the parent and/or child PAPA units 10, 30 from a coupled server via the Internet.

In a further embodiment, a mobile device such as a mobile phone or PDA can be similarly coupled to a personal computer and configured with PAPA software downloaded from a coupled server via the Internet. In the case of a mobile phone, the PAPA software may be downloaded to the mobile phone via a local cell site and base station using well-known transmission methods (e.g., CDMA, GSM). A fee may or may not be charged for the PAPA software, depending on the business model used. In this way, additional functionality to enable proximity monitoring as a parent and/or child PAPA unit can be easily added to a mobile device.

As may be apparent from the discussion above, the PAPA system for monitoring the proximity of a monitored child is simple to use, inexpensive, mobile, adaptable and secure. The PAPA system does not require complicated circuitry to determine exact distances or direction, or to engage location finding services such as services relying on the use of the GP system. Further, the design of the child PAPA unit prevents its easy removal from the monitored person or object, prevents a powered-off condition from occurring during use, prevents interruption of an established RF link to the parent PAPA unit 10 during use, and prevents RF link establishment with devices other than the parent PAPA device 10 during use. Moreover, establishing the monitoring piconet by the PAPA system is as easy as actuating a first button on the parent PAPA unit 10. Similarly, dissolving the monitoring piconet by the PAPA system is as easy as actuating a second button on the parent PAPA unit 10.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A method for detecting when a first mobile transceiver unit has moved a predetermined distance from a second mobile transceiver unit, the second mobile transceiver unit including a controller having a processor and a memory coupled to the processor, the method comprising:

establishing a communication between the second mobile transceiver unit and at least one first mobile transceiver unit;

providing a first indication indicating successful communication establishment between the second mobile transceiver unit and the at least one first mobile transceiver unit;

transmitting a periodic request for a first identification to the at least one first mobile transceiver unit, the first identification providing an identity of the at least one first mobile transceiver unit; and providing a second indication if a response to the periodic request for the first identification is not detected by the second mobile transceiver unit within a pre-selected time, the second indication indicating that the at least one first mobile transceiver unit has moved the predetermined distance from the second mobile transceiver unit;

detecting actuation of a first button of the second mobile transceiver unit, actuation of the first button enabling power to the second mobile transceiver unit;

detecting actuation of a second button of the second mobile transceiver unit after detecting actuation of the first button, actuation of the second button enabling establishment of the communication;

wherein establishing the communication comprises establishing a monitoring piconet, the monitoring piconet including Bluetooth enabled RF links between the second mobile transceiver unit and the at least one first mobile transceiver unit; and wherein establishing the monitoring piconet comprises:

causing an inquiry command to be transmitted in response to detecting actuation of the second button;

detecting receipt of a first data packet, the first data packet including the first identification and a first radio frequency operational parameter of the at least one first mobile transceiver unit;

causing a page command to be transmitted in response to detecting receipt of the first data packet, the page command including the first identification of the at least one first mobile transceiver unit;

detecting receipt of a second data packet transmitted in response to receipt of the page command, the second data packet including the first identification of the at least one first mobile transceiver unit;

causing a third data packet to be transmitted in response to detecting receipt of the second data packet, the third data packet including a second identification and a second radio frequency operational parameter of the second mobile transceiver unit;

detecting receipt of a fourth data packet transmitted in response to receipt of the third data packet, the fourth data packet including the first identification of the at least one first mobile transceiver unit and indicating that the first radio frequency operational parameter has been replaced by the second radio frequency operational parameter; and causing a monitoring piconet address of the monitoring piconet to be assigned to the first mobile transceiver unit.

2. The method of claim 1, wherein the first and second indications are selected from the group consisting of an audible indication provided by a speaker of the second mobile transceiver and a visual indication provided by a light emitting diode of the second mobile transceiver.

3. The method of claim 1, wherein the first indication comprises an audible chirp, and wherein the second indication comprises an audible alarm.

4. The method of claim 1, further comprising lockingly attaching the first mobile transceiver device to a monitored person and attaching the second mobile transceiver device to a monitoring person.

5. The method of claim 1, wherein the predetermined distance is in the range often meters.

6. The method of claim 1, wherein the pre-selected time comprises two seconds.

7. The method of claim 1, wherein the pre-selected time is in the range of one second to five seconds.

* * * * *